US006004221A

United States Patent [19]

Thornhill

[11] Patent Number: 6,004,221

[45] Date of Patent: Dec. 21, 1999

[54] GOLF PUTTER TRAINING DEVICE

[76] Inventor: Reginald L. Thornhill, 2213 Spring Leaf, Carrollton, Tex. 75006

[21] Appl. No.: 09/193,695

[22] Filed: Nov. 17, 1998

[51] Int. Cl.[6] ..... A63B 69/36

[52] U.S. Cl. ..... 473/227; 473/276

[58] Field of Search ..... 473/227, 201, 473/204, 218, 229, 212, 276

[56] References Cited

U.S. PATENT DOCUMENTS

| | | | |
|---|---|---|---|
| 1,684,192 | 9/1928 | Nemeth | 473/227 |
| 5,145,179 | 9/1992 | Breed . | |
| 5,248,146 | 9/1993 | Viets et al. . | |
| 5,259,621 | 11/1993 | Keefer . | |
| 5,470,073 | 11/1995 | Yasquez . | |
| 5,501,464 | 3/1996 | Dalbo . | |
| 5,551,696 | 9/1996 | Izett et al. . | |
| 5,711,716 | 1/1998 | O'Brien et al. . | |
| 5,851,156 | 12/1998 | Schwark | 473/227 X |

OTHER PUBLICATIONS

Swingyde On Line Every Time! 1995, Golf Inventions Pty Ltd, West Lakes, SA, Australia.

*Primary Examiner*—George J. Marlo

*Attorney, Agent, or Firm*—H. Dennis Kelly; Timmons & Kelly

[57] ABSTRACT

A forward arm and a rearward arm are attached to an attachment bracket. The bracket can be attached to a putter shaft or hand grip, below the hands of a person using the device. The forward and rearward arms have upper sections that pivot relative to lower sections of the arms. Contact bars on the upper ends of the arms have contact points that touch or are very close to the forearms of a person swinging the putter properly.

20 Claims, 2 Drawing Sheets

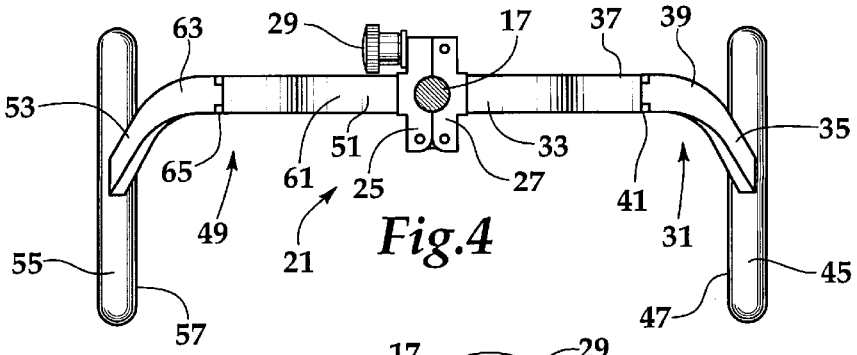
Fig.4
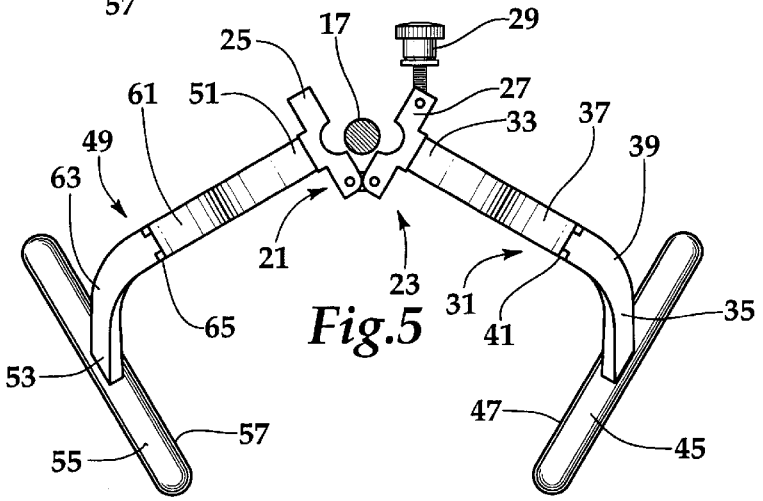
Fig.5
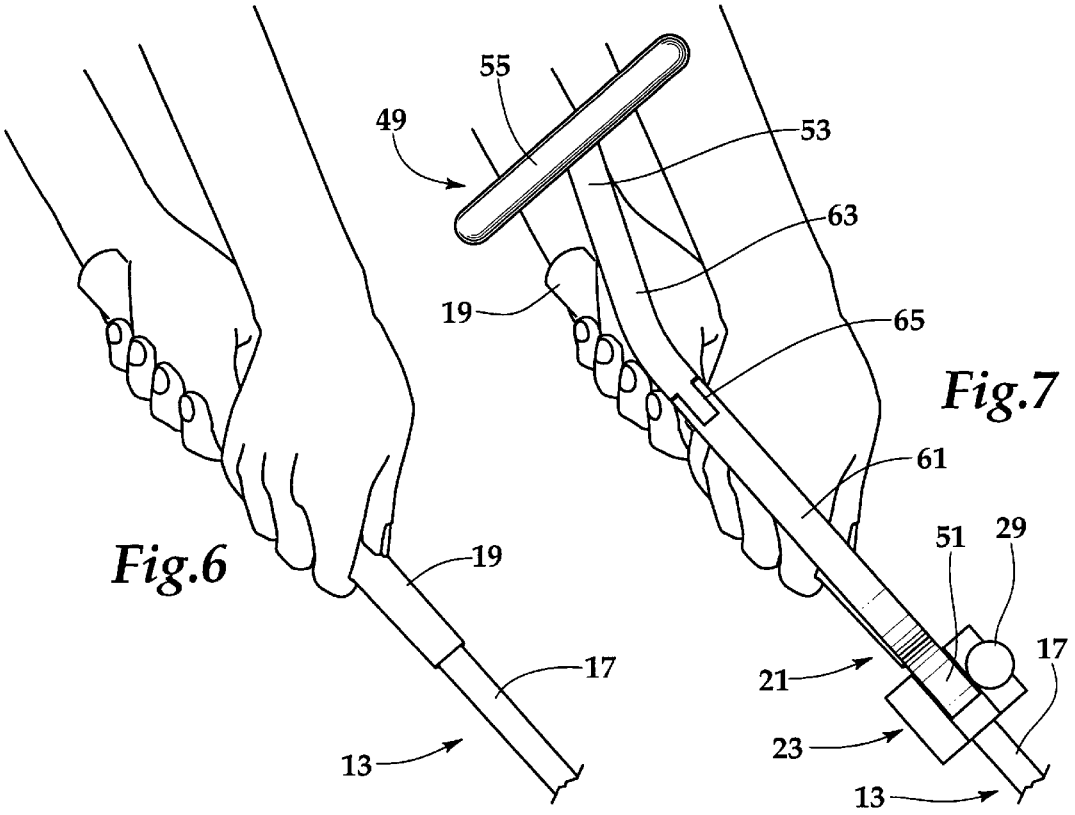
Fig.6
Fig.7

GOLF PUTTER TRAINING DEVICE

BACKGROUND OF THE INVENTION

1. Field of the Invention

This invention relates in general to golf training devices. In particular, the invention relates to devices for teaching and training proper putting technique.

2. Description of Related Art

Golfers have always looked for ways to take strokes off of their handicaps. Putting, in particular, has always been a major area of the game, and significant improvement in putting can, of course, make for great improvement in overall scores.

As a result, golf instructors have used many different devices for teaching and training proper putting technique. Many of these devices attach temporarily to the upper end of a putter, and have contacts that indicate the proper positions of the golfer's forearms during the putting stroke. Some of the prior art devices actually physically hold the forearms of the golfer in a proper position. The ones that do not hold the forearms touch the insides of the golfer's forearms.

A need remained for an effective golf putter training device that could be easily attached to and removed from a putter. Also, it was desired that the device not hold the person's forearms, but to merely touch the outsides of the forearms.

SUMMARY OF THE INVENTION

The general object of the method of the invention is to teach and to train golfers in a proper putting technique. In general, this object is accomplished by a golf putter training device that has a forward arm and a rearward arm, and an attachment bracket for attaching the device to a putter. The attachment bracket is attached to the putter below where the putter is gripped, either on the lower end of the grip, or just below the grip.

The lower end of each arm is attached to the attachment bracket. The upper ends of the arms have contact points that contact the forward side of the forward forearm, and the rearward side of the rearward forearm of the person swinging the putter properly. The arm of the device can be adjusted to fit the person using the device.

The above, as well as additional objects, features, and advantages of the invention will become apparent in the following detailed description.

BRIEF DESCRIPTION OF THE DRAWINGS

FIG. 4 is a bottom plan view of the golf putter training device of the invention, attached to a putter, as shown in FIG. 1, with the putter shown in cross-section.

FIG. 5 is a bottom plan view of the golf putter training device, being removed or attached to a putter.

FIG. 6 is a right side elevation of a person swinging a golf putter, without the golf putter training device of the invention attached.

FIG. 7 is a right side elevation of a person swinging a golf putter, with the golf putter training device of the invention attached.

DESCRIPTION OF THE PREFERRED EMBODIMENT

Figures 1, 2, 3:
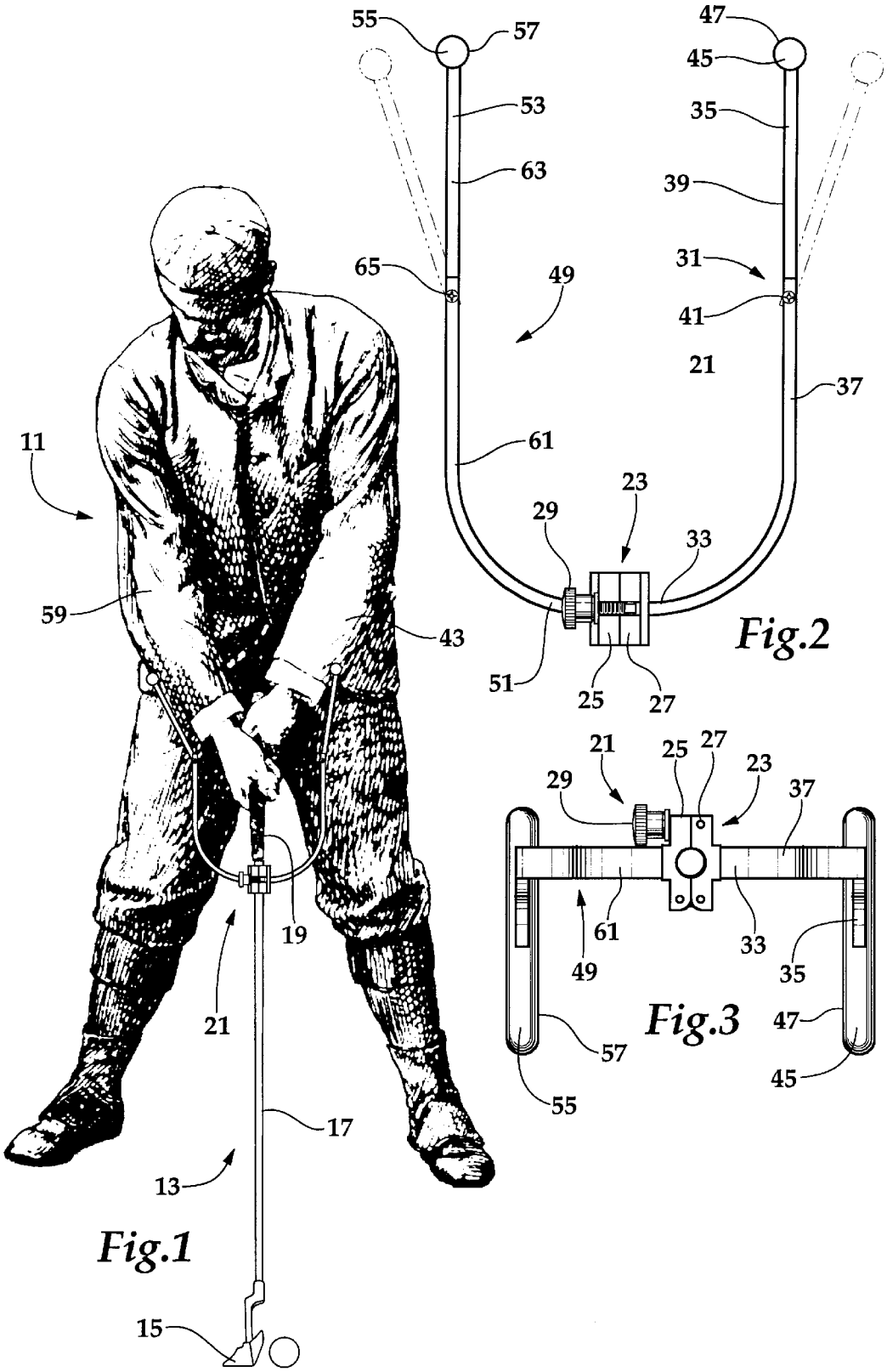
FIG. 1 is a front elevation of a person using the golf training device of the invention.
FIG. 2 is a front elevation of the golf training device of the invention, removed from the putter.
FIG. 3 is a bottom plan view of the golf training device of the invention, removed from the putter.

A golfer 11 properly using a golf putter 13 will grip the club 13 with his forearms forming a "V", as shown in FIG. 1. During a proper putting stroke, this "V" should be maintained, relative to the golf putter 13.

In the following description, the golfer's forward side will be considered the side of the golfer toward the direction that the golf ball is to travel. For a right-handed golfer, therefore, the left arm of the golfer will be the forward arm. For a left-handed golfer, then, the forward arm would be the right arm. The golfer 11 shown in the drawings is right-handed, but the invention is equally useful for left-handed golfers.

A golf putter 13 generally has a club head 15, a shaft 17, and a hand grip 19. The golfer's hands grip the hand grip 19 of the club 13, but a portion of the hand grip 19 extends below the golfer's hands.

The golf putter training device 21 of the invention has an attachment bracket 23 that can be attached to the putter 13 at a point below the hands of the golfer 11. The bracket 23 can be attached to the shaft 17 or to the lower end of the hand grip 19. Either connection would be acceptable.

The attachment bracket 23 has two halves 25 and 27, that are connected together on one side. Therefore, the bracket 23 can be opened, as shown in FIG. 5, and then closed around the shaft 17 of a putter 13, as shown in FIG. 4. A threaded knob 29 can then be tightened to hold the two halves 25 and 27 of the bracket 23 together. The device 21 is easily removed from the putter 13 by loosening the threaded knob 29, and then opening the attachment bracket 23. Other familiar types of attachment brackets 23 could also be used with the golf training device of the invention.

The golf training device 21 has a forward arm 31 having a lower end 33 and an upper end 35. The lower end 33 of the forward arm 31 is attached to one half 27 of the attachment bracket 23. The forward arm 31 has a lower section 37 and an upper section 39, connected by a connector 41 that allows the upper section 39 to be pivoted relative to the lower section 37, as shown in FIG. 2. This allows the device 23 to be adjusted to the arm size and the arm position of the golfer 11. In use, the upper section 39 is adjusted to fit the position of the forward forearm 43 of the person 11 using the device 21, as shown in FIG. 1.

The lower section 37 of the forward arm 31 is curved from horizontal, at the lower end 33, to vertical, at the connector 41. The upper section 39 is also curved, in a different plane, as shown in FIGS. 3–5.

The forward arm 31 also has a contact bar 45 on the upper end 35 of the arm 31. This contact bar 45 has a contact point 47 that contacts, or is very close to the forward forearm 43 of a person 11 swinging the putter 13 properly.

The golf putter training device 21 also has a rearward arm 49 that is a mirror image of the forward arm 31. Similar to the forward arm 31, the rearward arm 49 has a lower end 51 and an upper end 53. The lower end 51 is attached to the attachment bracket 23, and the upper end 53 has a contact bar 55. A contact point 57 on the contact bar 55 touches, or is very close to, the rearward forearm 59 of a person 11 swinging the putter 13 properly, as shown in FIG. 1.

The rearward arm 49 has a lower section 61 and an upper section 63, connected by a connector 65 that allows the upper section 63 to be pivoted relative to the lower section 61.

The golf putter training device 21 is temporarily attached to a putter 13 by opening the attachment bracket 23, as shown in FIG. 5. The bracket 23 is then closed around the shaft 17 or the hand grip 19 of the putter 13, as shown in FIG. 4. The threaded knob 29 is then tightened to hold the device 21 in place.

The upper section 39 of the forward arm 21 is then pivoted to place its contact bar 45 in proper position, and the upper section 63 of the rearward arm 49 is pivoted to place its contact bar 55 in proper position. The club 13 can then be properly gripped, as shown in FIG. 1, with the forearms 43 and 59 either barely touching or very close to the contact points 47 and 57. As the putter 13 is swung properly, the forearms 43 and 59 will remain in the identical position relative to the contact points 47 and 57. Therefore, a proper putting stroke is taught to the person using the device 21.

The device 21 of the invention has several advantages over the prior art. The device 21 is easy to install and to remove, so that the putter 13 can be used for training and for an actual game. The device 21 is easily adjusted to the size and to the unique forearm positions of the person 11 using it. Also, the device 21 is easy to use, and quickly teaches a proper putting stroke.

The invention has been described in only one embodiment. It should be apparent to those skilled in the art that the invention is not so limited, but is susceptible to various changes and modifications without departing from the spirit of the invention.

I claim:

1. A golf putter training device, for temporary attachment to a golf putter having a hand grip, for training a person to hold the putter properly, wherein the device comprises:

an attachment bracket for attachment to the golf putter such that the person's hands are positioned above the bracket when the person holds the golf club;

a forward arm, having a lower end and an upper end, wherein the lower end is connected to the attachment bracket, and wherein the forward arm has a contact point for contacting the forward forearm of the person swinging the putter properly; and a rearward arm, having a lower end and an upper end, wherein the lower end is connected to the attachment bracket, and wherein the rearward arm has a contact point for contacting the rearward forearm of the person swinging the putter properly.

2. A golf putter training device, as recited in claim 1, wherein the contact point on the forward arm contacts the forward side of the person's forward forearm, and the contact point on the rearward arm contacts the rearward side of the person's rearward forearm.

3. A golf putter training device as recited in claim 2, wherein the forward arm further comprises:

a lower section, including the lower end of the forward arm; and an upper section, including the upper end of the forward arm, wherein the upper section is pivotably attached to the lower section.

4. A golf putter training device as recited in claim 3, wherein the upper section is pivotably attached to the lower section, to allow the upper section to pivot forward and rearward relative to the lower section.

5. A golf putter training device, as recited in claim 4, wherein the upper section of the forward arm is curved.

6. A golf putter training device, as recited in claim 5, wherein the forward arm further comprises a contact bar attached to the upper section, and wherein the contact bar includes the contact point.

7. A golf putter training device, as recited in claim 6, wherein the rearward arm further comprises:

a lower section, including the lower end of the rearward arm; and an upper section, including the upper end of the rearward arm, wherein the upper section is pivotably attached to the lower section.

8. A golf putter training device as recited in claim 7, wherein the upper section of the rearward arm is pivotably attached to the lower section of the rearward arm, to allow the upper section of the rearward arm to pivot forward and rearward relative to the lower section of the rearward arm.

9. A golf putter training device, as recited in claim 8, wherein the upper section of the rearward arm is curved.

10. A golf putter training device, as recited in claim 9, wherein the rearward arm further comprises a contact bar attached to the upper section of the rearward arm, and wherein the contact bar includes the contact point.

11. A golf putter training device, for temporary attachment to a golf putter having a hand grip, for training a person to hold the putter properly, wherein the device comprises:

an attachment bracket for attachment to the putter such that the person's hands are positioned above the bracket when the person holds the golf club;

a forward arm, having a lower end and an upper end, wherein the lower end is connected to the attachment bracket, and wherein the forward arm has a contact point for contacting the forward forearm of the person swinging the putter properly, but wherein the forward arm is not attached to the person's forearm; and a rearward arm, having a lower end and an upper end, wherein the lower end is connected to the attachment bracket, and wherein the rearward arm has a contact point for contacting the rearward forearm of the person swinging the putter properly, but wherein the rearward arm is not attached to the person's forearm.

12. A golf putter training device, as recited in claim 11, wherein the contact point on the forward arm contacts the forward side of the person's forward forearm, and the contact point on the rearward arm contacts the rearward side of the person's rearward forearm.

13. A golf putter training device as recited in claim 12, wherein the forward arm further comprises:

a lower section, including the lower end of the forward arm; and an upper section, including the upper end of the forward arm, wherein the upper section is pivotably attached to the lower section.

14. A golf putter training device as recited in claim 13, wherein the upper section is pivotably attached to the lower section, to allow the upper section to pivot forward and rearward relative to the lower section.

15. A golf putter training device, as recited in claim 14, wherein the upper section of the forward arm is curved.

16. A golf putter training device, as recited in claim 15, wherein the forward arm further comprises a contact bar attached to the upper section, and wherein the contact bar includes the contact point.

17. A golf putter training device, as recited in claim 16, wherein the rearward arm further comprises:

a lower section, including the lower end of the rearward arm; and an upper section, including the upper end of the rearward arm, wherein the upper section is pivotably attached to the lower section.

18. A golf putter training device as recited in claim 17, wherein the upper section of the rearward arm is pivotably attached to the lower section of the rearward arm, to allow the upper section of the rearward arm to pivot forward and rearward relative to the lower section of the rearward arm.

19. A golf putter training device, as recited in claim 18, wherein the upper section of the rearward arm is curved.

20. A golf putter training device, as recited in claim 19, wherein the rearward arm further comprises a contact bar attached to the upper section of the rearward arm, and wherein the contact bar includes the contact point.

* * * * *